US005860482A

United States Patent [19]

Gremillion et al.

[11] Patent Number: 5,860,482

[45] Date of Patent: Jan. 19, 1999

[54] MULTIPLE FORCE HOLE FORMING DEVICE

[75] Inventors: Ernest J. Gremillion, Cut Off; Steven M. Gremillion, Larose; Richard A. Gremillion, Cut Off, all of La.

[73] Assignees: Ernie J. Gremillion, Larose; Hazel T. Gremillion, Cut Off, both of La.; part interest to each

[21] Appl. No.: 593,969

[22] Filed: Jan. 30, 1996

[51] Int. Cl.[6] ..... E21B 7/26; E21B 11/02

[52] U.S. Cl. ..... 175/19; 175/57; 175/55; 175/189

[58] Field of Search ..... 175/19, 55, 57, 175/189, 52, 170

[56] References Cited

U.S. PATENT DOCUMENTS

| | | | |
|---|---|---|---|
| 2,667,752 | 2/1954 | Moseley | 175/19 |
| 2,728,555 | 12/1955 | Burg et al. | 175/57 |
| 3,054,285 | 9/1962 | Roosen | 175/19 |
| 3,106,258 | 10/1963 | Müller | 175/55 |
| 3,242,999 | 3/1966 | Garner | 175/19 |
| 3,291,227 | 12/1966 | Bodine, Jr. | 175/19 |
| 3,394,766 | 7/1968 | Lebelle | 173/49 |
| 3,479,829 | 11/1969 | Goodman | 175/19 |
| 3,710,876 | 1/1973 | Christensen | 175/19 X |
| 3,752,242 | 8/1973 | Gremillion | 175/108 |
| 3,920,083 | 11/1975 | Makita | 173/49 |
| 3,939,771 | 2/1976 | McReynolds | 102/21.8 |
| 4,278,025 | 7/1981 | McReynolds | 181/116 |
| 4,471,669 | 9/1984 | Seaberg | 74/687 |
| 4,530,410 | 7/1985 | Kay | 175/57 |
| 4,546,703 | 10/1985 | Thompson | 102/333 |
| 4,553,443 | 11/1985 | Rossfelder et al. | 74/22 R |
| 4,603,748 | 8/1986 | Rossfelder et al. | 175/19 |
| 4,819,740 | 4/1989 | Warrington | 173/49 |
| 4,850,439 | 7/1989 | Lund | 175/52 |
| 5,281,775 | 1/1994 | Gremillion | 181/116 |
| 5,343,002 | 8/1994 | Gremillion | 181/116 |

*Primary Examiner*—Frank Tsay

*Attorney, Agent, or Firm*—Jacobson, Price, Holman & Stern, PLLC

[57] ABSTRACT

A device and method for forming a downwardly extending hole in the surface of the earth for seismic exploration or for forming a larger diameter hole such as made during exploratory drilling. The hole forming device includes an elongated rigid planting member having a point or tip at its lower end which is forced downwardly into the earth's surface by a combination of forces. The multiple forces may include a primary downward force exerting a substantially constant downward push on the planting member and either or both additional forces imparted to the planting member when the primary force no longer moves the planting member downwardly. The additional forces include a vibrating force applied to the planting member and a force formed by injection of high pressure low volume liquid into a subsurface formation from the lower end of the planting member to separate, saturate, liquefy or condition a compacted or resistant formation to enable penetration of a formation structure that resists penetration by the downward force.

30 Claims, 2 Drawing Sheets

MULTIPLE FORCE HOLE FORMING DEVICE

BACKGROUND OF THE INVENTION

1. Field of the Invention

This invention relates to an apparatus for forming a downwardly extending hole in the surface of the earth for seismic exploration or for forming a larger diameter hole such as made during exploratory drilling. The hole forming device includes an elongated rigid planting member having a point or tip at its lower end which is forced downwardly into the earth's surface by a combination of forces. The multiple forces may include a primary downward force exerting a substantially constant downward push on the planting member and either or both additional forces imparted to the planting member when the primary force no longer moves the planting member downwardly. The additional forces include a vibrating force applied to the planting member and a force formed by injection of high pressure low volume liquid into a subsurface formation from the lower end of the planting member to separate, saturate, liquefy or condition a compacted or resistant formation to enable penetration of a formation structure that resists penetration by the downward force.

2. Description of the Prior Art

U.S. Pat. No. 5,281,775 issued Jan. 25, 1994 discloses a hole forming device in the form of a vertically moveable pipe planting member having a point on the lower end which is moved downwardly and when a resistance to downward movement is encountered which stops or substantially slows movement of the planting pipe, a vibration force is then applied to the planting pipe to move the planting pipe downwardly through the resisting formation structure.

U.S. Pat. No. 5,343,002 issued Aug. 30, 1994 discloses a disposable point mounted on the lower end of a planting pipe which remains in the formed hole when the planting pipe is retracted and removed.

The prior art of record in the above two patents disclose devices relating to this field of endeavor. The prior patents of record are as follows:

| | |
|---|---|
| 3,106,258 | 4,278,025 |
| 3,242,999 | 4,471,669 |
| 3,394,766 | 4,546,703 |
| 3,752,242 | 4,553,443 |
| 3,920,083 | 4,819,740 |
| 3,939,771 | |

The above patents do not disclose a hole forming device for seismic exploration utilizing multiple forces as disclosed in this invention.

SUMMARY OF THE INVENTION

An object of the invention is to provide a hole forming device for seismic exploration in which an elongated rigid planting member having a point or tip at the lower end is forced downwardly into the earth's surface to a predetermined depth. The vertical planting member is moved downwardly by a plurality of forces which are sequentially applied depending upon the resistance to penetration of the underground formation. Initially, a downward push of substantially constant magnitude is applied to the planting member to move the planting member downwardly until downward movement is stopped or substantially slowed by resistance to penetration by the underground formation.

Secondly, one of two or both additional forces are applied selectively to the planting member. One of the additional forces is a vibration force applied to the planting member which combined with the constant downward force will cause downward movement of the planting member until resistance to penetration is encountered that will stop or substantially slow penetration resulting from the two forces that have been applied to the planting member. The other additional force is injection of high pressure liquid from the lower end of the planting member utilized to condition the underground formation to overcome the resistance to penetration to enable a vertical hole or bore to be formed to a predetermined desired depth in the underground formation. The two additional forces are selectively individually applied or they are sequentially applied to the planting member.

Another object of the invention is to provide a hole forming device in accordance with the preceding object in which the additional forces are applied manually when a resistance to penetration which substantially slows or stops downward movement of the planting member is encountered or either or both of the additional forces are applied automatically when the resistance to penetration of the point on the planting member exceeds the force exerted on the planting member by the primary force.

A further object of the invention is to provide a hole forming device in which the planting member is in the form of a pipe having a point on the lower end with the pipe including a passageway for high pressure liquid, such as water, and the point at the lower end of the pipe includes a discharge orifice, orifices or a spray nozzle with the water injection being at high pressure and low volume to separate, saturate or liquefy densely compacted formation areas to provide penetration through underground structures which resisted the primary force and/or a secondary vibration force applied to the planting pipe.

Still another object of the invention is to provide a hole forming device in accordance with the preceding objects in which the downward movement of the planting pipe displaces materials into the side wall of the hole being formed through the formation by compressing and compacting the displaced materials into the side wall of the bore or hole. The injection of high pressure, low volume water at the lower end of the planting pipe enhances the displacement capability of the underground formation materials thereby enhancing the piercing capability of the point and planting pipe and conditioning the side wall of the hole to facilitate deposit of displaced materials by absorption into the surrounding saturated formation and/or compression into the side wall of the hole as it is being formed.

A still further object of the invention is to provide a hole forming device in accordance with the preceding objects in which the nozzle or orifice arrangement in the point or lower end of the planting pipe discharges high pressure, low volume water axially and/or radially in various nozzle patterns to enhance reduction of resistance to penetration for various types of penetration resistant underground formations.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
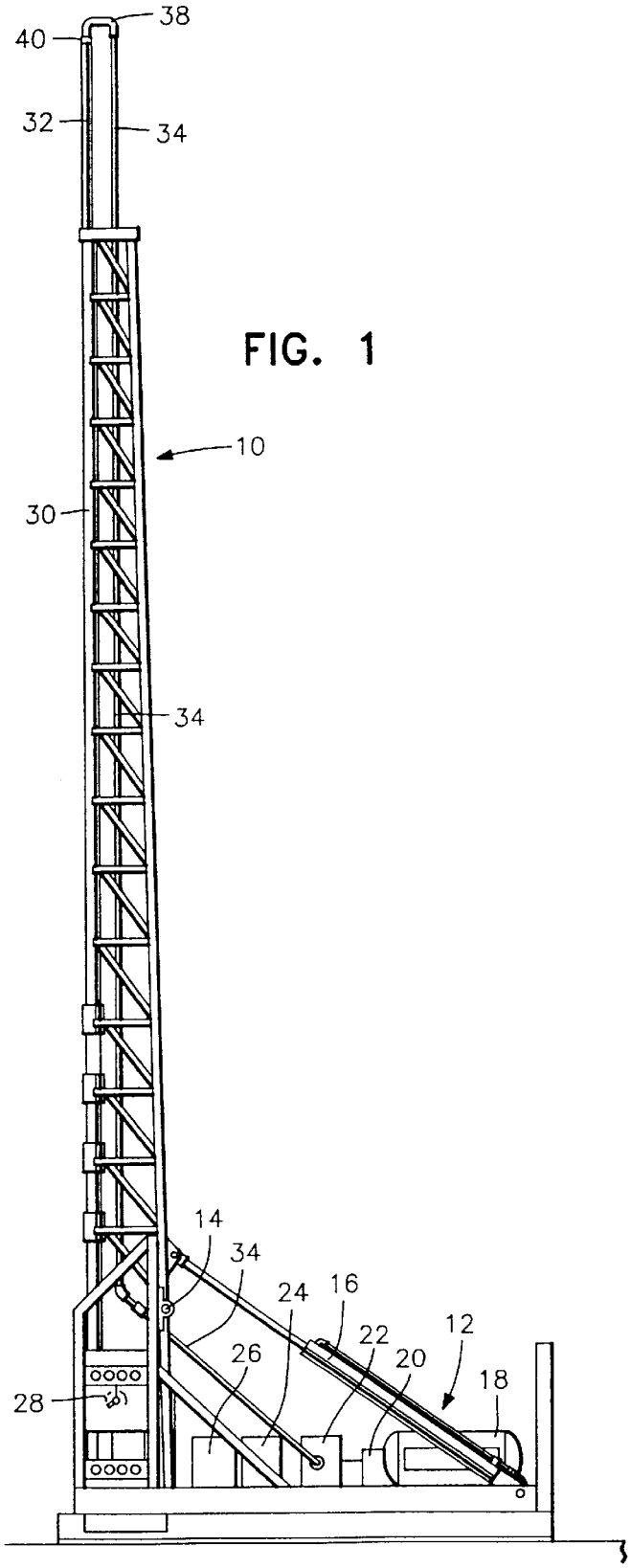
FIG. 1 is a side elevational view of the hole forming device of this invention.
Figure 2:
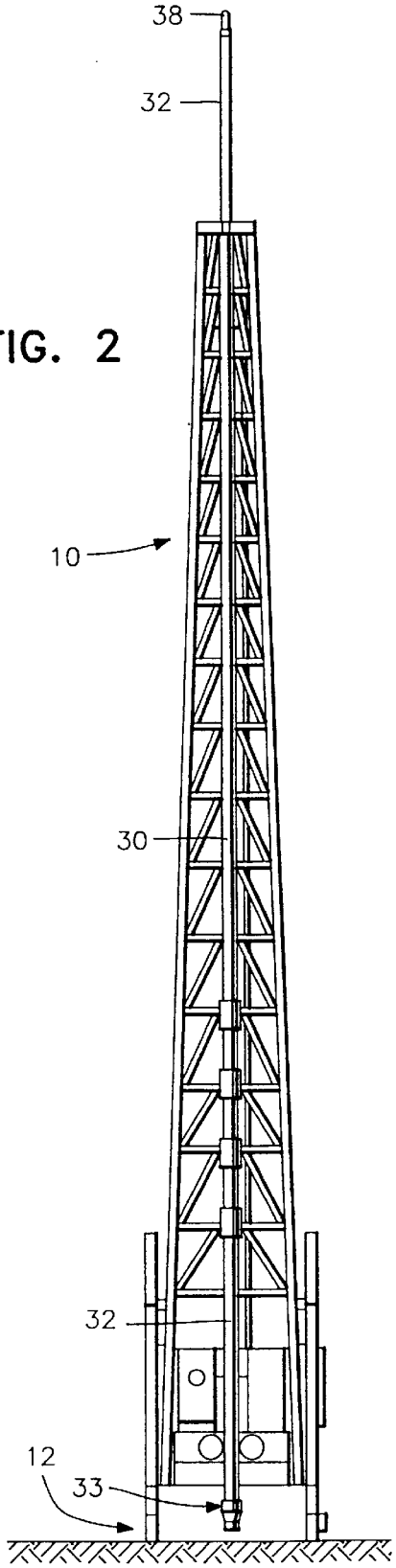
FIG. 2 is an end elevational view of the hole forming device illustrating the general orientation of components.

Referring now to the drawings, FIGS. 1 and 2 illustrate the general construction of the hole forming device of the present invention which includes a generally vertically disposed tower or framework 10 similar to that disclosed in U.S. Pat. No. 5,281,775. The tower is supported on a supporting frame or skid 12 which may be supported on a land vehicle, vessel or the like. The lower end of the tower 10 may be pivoted to the supporting platform by pivotal connection 14 with a hydraulic piston and cylinder assembly 16 moving the tower from a horizontal collapsed transport position to a vertical operative position. The supporting frame or skid 12 includes a motor or prime mover 18 driving a pump unit 20 to supply hydraulic pressure and a pump unit 22 to supply high pressure water. Tank assemblies 24 and 26 may be provided on the skid along with control units 28 to enable the pumps to supply hydraulic pressure and high pressure low volume water. The tower 10 includes a generally semicylindrical guide pipe or tube 30 at a corner of the tower aligned with an end portion of skid 12. An elongated planter pipe, rod or the like 32 is guided during its vertical movement by guide pipe 30. The planter pipe 32 includes a point or tip 33 at its lower end. The structure of the tower, guide tube and planter pipe function in the same manner as in U.S. Pat. No. 5,281,775 including the structure for moving the planter pipe 32 downwardly under a substantially constant downward pushing force of constant magnitude by using a rack and pinion gear arrangement. Also, a vibrating mechanism is connected to the planter pipe 32 to apply an additional force in the form of vibration forces to the planting pipe in the same manner as in U.S. Pat. No. 5,281,775, the disclosure of which is incorporated herein by reference thereto.

Figure 3:
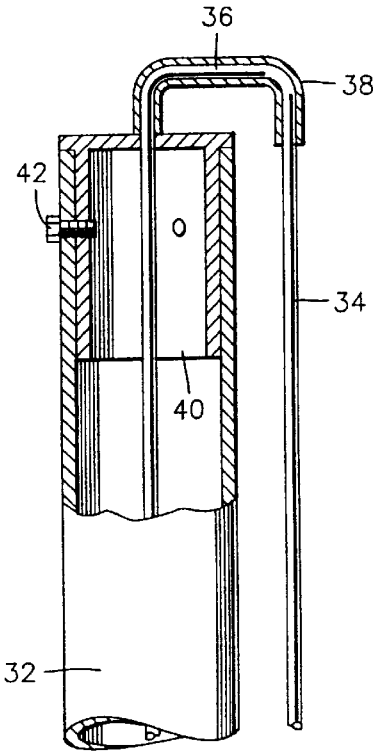
FIG. 3 is an enlarged fragmental sectional view of the upper end of the planting pipe illustrating one embodiment of a high pressure fluid line connected thereto.

In addition to or in lieu of the vibration forces, an additional force is applied to the planting member in the form of injection of high pressure low volume water into the formation from the lower end of planter pipe 32. High pressure water is supplied to the planter pipe 32 from the high pressure pump 22 through a high pressure flexible line or conduit 34 which extends upwardly in the tower alongside the planter pipe 32 as illustrated in FIG. 3. The upper end of the high pressure supply conduit 34 is reversely curved at its upper end as indicated by reference numeral 36 and is received in a rigid U-shaped tube 38 that is rigid with the planter pipe 32. The line or conduit 34 extends downwardly into the interior of the planter pipe 32 and is positioned centrally therein by the guide tube 38 mounted centrally on a sleeve 40 which telescopes into the upper end of the planter pipe 32 forming a closure cap therefor and being secured in place by a plurality of fastening bolts 42. With this construction, the portion of line or conduit 34 which may be in the form of a flexible hose, rigid pipe, tubing or the like extends downwardly generally in the center of the planter pipe 32 toward the point or tip 33 at the lower end of the planter pipe 32.

Figure 4:
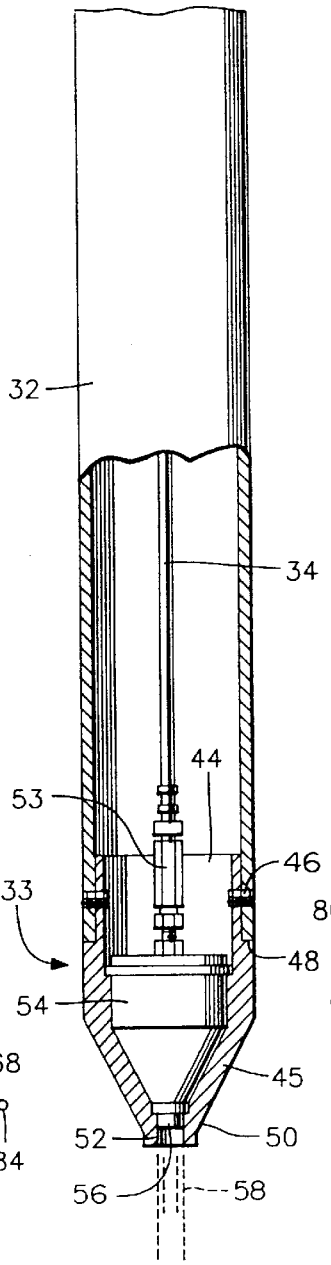
FIG. 4 is an enlarged fragmental sectional view of the lower end of the planting pipe illustrating the structure of the point and high pressure fluid discharge nozzle arrangement.

As illustrated in FIG. 4, the tip or point 33 includes a cylindrical steel sleeve 44 telescoped into the lower end of the planter pipe 32 and secured thereto by fastening bolts 46 having the outer ends thereof generally flush with the outer surface of the planter pipe 32. The sleeve 44 includes an external shoulder 48 which abuttingly engages the lower end of the planter pipe 32 to provide a solid connection between the planter pipe 32 and the point 33. The lower end portion 45 of the sleeve 44 tapers inwardly as at 50 into a generally conical configuration terminating in an opening 52 at the lower end thereof. The line or conduit 34 extends downwardly to the point 33 and is connected to a filter assembly 53 communicating with a high pressure water discharge device such as a commercially available unit identified as a "Water Blaster" manufactured by Simpson Cleaning Systems, Inc. of Clearwater, Fla. which includes a tapered housing 54 and a discharge orifice 56 extending through opening 52 in the tapering lower end 45 of the sleeve 44 for discharging high pressure low volume water as a rotating spray 58 downwardly from the point 33. Attached hereto and identified as Exhibit A is a disclosure of the "Water Blaster". Other types of discharge nozzles may be associated with the sleeve 44 to provide a high pressure discharge spray directed toward the formation.

Figure 5:
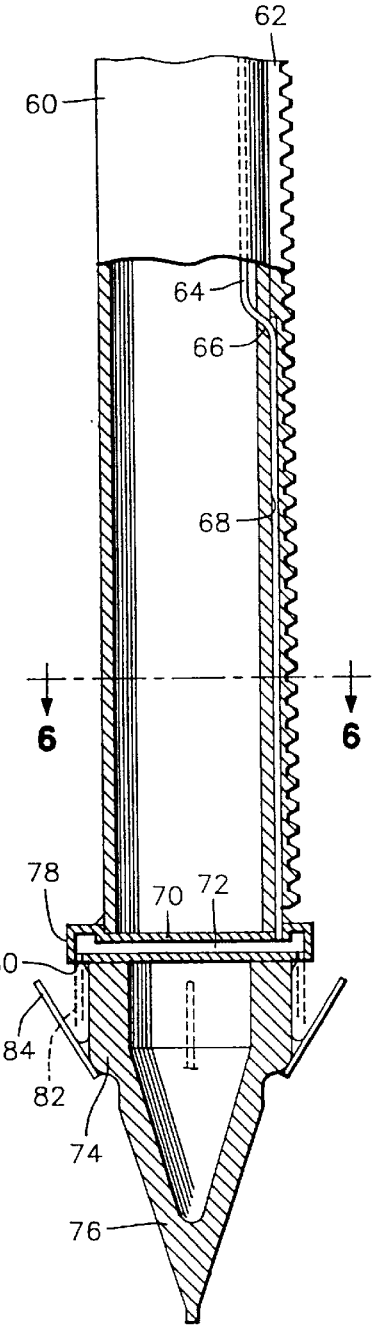
FIG. 5 is an enlarged sectional view of the lower end of the planting pipe illustrating another type of high pressure fluid passageway discharge nozzle arrangement and disposable point.
Figure 6:
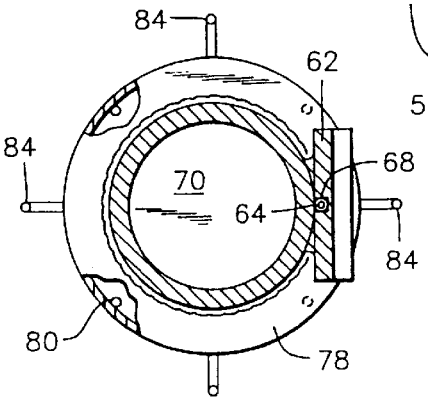
FIG. 6 is a transverse, sectional view taken along section line 6—6 on FIG. 5 illustrating further structural details of this embodiment of the invention.

FIGS. 5 and 6 illustrate another embodiment of the invention in which the planter pipe 60 has a rack gear 62 mounted longitudinally thereon as disclosed in detail in U.S. Pat. No. 5,281,775. In this form of the invention, a high pressure low volume water supply tube 64 is oriented adjacent the inner surface of the planting pipe 60 immediately in alignment with and adjacent to the rack gear 62. Near the lower end of the planter pipe 60 the tube 64 extends through an opening 66 in the pipe and then passes downwardly through a passageway 68 formed in the inner surface of the rack gear 62 as illustrated in FIG. 6. The high pressure tube 64 connects with a hollow manifold 70 which includes a hollow interior 72 extending transversely of the pipe 60 and beyond the periphery of a cylindrical sleeve 74 having a tapered generally conical point 76 forming a closure for the sleeve 74. The outer periphery of the manifold 70 which is designated by the reference numeral 78 extends outwardly beyond the outer circumference of the sleeve 74 and this projecting portion of the manifold is provided with a plurality of orifices or nozzles 80 which open downwardly and discharge high pressure, low volume water 82 downwardly alongside the sleeve 74. The manifold 70 may be in the form of a hollow plate or in the form of a hollow annular member with the number and location of the nozzles or orifices 80 being varied. The sleeve 74 includes flexible wings 84 oriented in circumferentially spaced relation and in upwardly and outwardly inclined relation which enables them to flex inwardly as the planting pipe moves downwardly and engage the side wall of the hole or bore to separate the sleeve 74 and point 76 from the planter pipe when the planter pipe is retracted and anchor the point in the hole in a manner described in detail in U.S. Pat. No. 5,281,775. The disposable point disclosed in FIGS. 5 and 6 enables an explosive charge or other equipment positioned in the point 76 and sleeve 74 to be deposited in the bottom of the hole for seismic exploration.

The high pressure, low volume water discharged through the disposable point defines an additional force combined with the substantially constant downward force as a primary force and in addition or in lieu of a vibration force as an additional force which enables penetration of underground formations that cannot be penetrated by the primary downward push or force alone or when combined with the additional vibration force. The low volume of water penetrates into the formation and the side wall of the hole or bore and does not circulate back to the ground surface. The use of the additional force of the high pressure, low volume water injected at or below the point will separate, saturate and liquefy the elements of the densely compacted formation to provide penetration through formation structures previously impenetratable by the use of the primary force and/or the additional vibration force. The downward push and vibration displaces materials into the side wall of the hole through compression and compaction. When the resisting density of a formation overcomes the displacement force or forces exerted on the planter pipe, the planter pipe will stall. When this occurs, the injection of water under high pressure into the formation from the lower end of the pipe or point increases the penetration capability of the hole forming device. Exposing the surface or subsurface densely packed formation elements, usually consisting of clay, silt, gravel or shale, to high pressure water discharged through a stationary or rotating nozzle or orifice enhances the displacement capabilities of these formation materials. This not only produces exceptional piercing capability but also conditions the side wall of the bore by depositing displaced materials by either absorption into the surrounding saturated formation and/or compression into the side wall of the hole as it is being formed.

Previous efforts in this type of formation penetration have been by use of flush or circulating type drilling equipment which usually includes a rotating bit which bores through a formation and produces shavings or cuttings. These cuttings or displaced materials must be moved to achieve additional penetration. This removal process is normally performed by circulating drilling fluids or mud down through the drilling pipe and bit and into the bore in the formation to flush the shavings and cuttings to the ground surface for disposal.

The invention using the multiple forces provides advantages of performance with the hole forming techniques providing access through practically any type of formation except for granite, limestone and some shale formations, with relatively light weight equipment and the use of high pressure water facilitates movement of displaced material into the formation which eliminates the problems of disposal of displaced cuttings or shavings.

In a test installation, a high pressure pump supplying water at a pressure from 1,000 to 10,000 psi at a capacity of 1 to 20 gpm was used with the piping from the pump including high pressure flexible hose arrangements, piping or tubing to the upper end of the planting pipe and down to the nozzle or tip at the discharge point on the pipe. Also, the planting pipe itself can function as the structure for conveying the high pressure liquid to the nozzle or tip in which the planting pipe itself is pressurized. Thus, the high pressure hose, pipe, tubing or the like may be routed through the planting pipe, externally of the planting pipe or combination of both with the planting pipe. Also, the planting pipe can be pressurized in those situations in which the hose, pipe or tubing does not extend downwardly through the planting pipe.

When the planting pipe has its interior pressurized, the structure is especially useful in exploratory drilling operations in which the pipe has a larger diameter to form a larger hole by applying the multiple forces to the planter pipe without rotating the pipe and without use of drilling mud or circulating fluid.

Various types of discharge tips or nozzles can be used with the discharge tip preferably being at the lower end of the planting pipe and incorporated into the point depending upon the application or formation. The discharge points or nozzles may be oriented in various areas depending upon the formation encountered. As illustrated in FIGS. 3–6, the discharge nozzle may be a centrally located axially opening nozzle arrangement or may be a plurality of downwardly directed circumferentially spaced discharge nozzles or orifices. Also, the hose, pipe or tubing extending down through the planting pipe may be connected to a rotating type "Water Blaster" discharge nozzle in which the pressure was maintained at 3,000 psi with a flow rate of 4.5 gpm.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A hole forming device for forming a hole downwardly into the surface of the earth, said device comprising a frame, an elongated vertically oriented guide supported by said frame, an elongated vertically mounted rigid planting member reciprocally, non-rotatatively supported and guided by said guide, said planting member including a point at a lower end thereof, means interconnecting said frame and planting member to move said planting member vertically in relation to the guide, and means discharging high pressure liquid from the lower end of said planting member to enhance penetration of the planting member into a penetration resistant earth formation encountered when the planting member is moved downwardly to form a hole in the earth.

2. The hole forming device as defined in claim 1 wherein said means discharging high pressure liquid including means discharging a low volume of high pressure liquid to condition the side wall of the hole and for absorption of the liquid into the formation thereby eliminating discharge of liquid upwardly between the planting member and the hole formed by the planting member.

3. The hole forming device as defined in claim 1 wherein said means discharging high pressure liquid including an axially extending discharge nozzle in the point at the lower end of the planting member.

4. The hole forming device as defined in claim 1 wherein said means discharging high pressure liquid including a hollow manifold at the lower end of the planting member at its juncture with said point, said manifold including a plurality of downwardly opening orifices to discharge high pressure liquid peripherally of said point.

5. The hole forming device as defined in claim 4 including means applying vibrating forces to said planting member to enhance the penetrating capabilities of said point, said means moving said planting member vertically forming a primary penetrating force of substantially constant magnitude and the means applying vibrating forces and means discharging high pressure liquid from the lower end of the planting member forming selectively applied additional penetrating forces to the planting member.

6. The hole forming device as defined in claim 4 wherein said means discharging high pressure liquid including means discharging a low volume of high pressure liquid to condition the side wall of the hole and for absorption of the liquid into the formation thereby eliminating discharge of liquid upwardly between the planting member and the hole formed by the planting member.

7. The hole forming device as defined in claim 4 wherein said manifold projects outwardly peripherally of said point, said orifices directing discharge of high pressure liquid downwardly adjacent an outer surface of said point.

8. The hole forming device as defined in claim 1 including means applying vibrating forces to said planting member to enhance the penetrating capabilities of said point, said means moving said planting member vertically forming a primary penetrating force of substantially constant magnitude and the means applying vibrating forces and means discharging high pressure liquid from the lower end of the planting member forming selectively applied additional penetrating forces to the planting member.

9. The hole forming device as defined in claim 1 wherein said means discharging low volume high pressure water includes orifice means discharging water at a high velocity axially downwardly and rotatably from the point on the planting member.

10. The hole forming device as defined in claim 9 including means applying vibrating forces to said planting member to enhance the penetrating capabilities of said point, said means moving said planting member vertically forming a primary penetrating force of substantially constant magnitude and the means applying vibrating forces and means discharging high pressure liquid from the lower end of the planting member forming selectively applied additional penetrating forces to the planting member.

11. The hole forming device as defined in claim 1 wherein said planting member is a rigid pipe, a pump supplying water under pressure to the interior of the pipe, said means discharging high pressure liquid from the lower end of the planting member including a tapered point attached to the lower end of said pipe, said tapered point including a discharge opening at the lower end of the tapered point, a water discharge nozzle mounted in said point to discharge high pressure low volume water through said discharge opening.

12. The hole forming device as defined in claim 11 wherein said water discharge nozzle discharges water as a downwardly directed water spray.

13. The hole forming device as defined in claim 1 wherein said point includes upwardly and outwardly inclined wings for engaging a peripheral wall of the hole formed by the point to separate the point from the planting member when the planting member is retracted thereby leaving the point in the hole.

14. The method of forming a hole in the surface of the earth consisting of the steps of positioning a vertically elongated rigid member at a site where a hole is desired, applying a substantially constant downward force on said member to move it downwardly into the earth, and discharging high pressure water from the lower end of said member when said member encounters a resistance greater than can be overcome by said substantially constant force whereby the substantially constant downward force, and the discharge of water combine to move said member downwardly through the encountered penetration resistant formation.

15. The method as defined in claim 14 together with the steps of releasably mounting a pointed lower end on the vertical member and disconnecting the pointed lower end from the elongated member when the elongated member is retracted thereby leaving the pointed lower end in the bottom of a formed hole in the earth.

16. The method as defined in claim 15 together with the step of anchoring the pointed lower end in the bottom of the formed hole when retracting the elongated member.

17. The method as defined in claim 14 together with the step of selectively applying vertical vibratory force to said elongated member when the steps of applying a downward force and discharging high pressure water do not penetrate a resistant formation.

18. The method as defined in claim 14 wherein the step of discharging high pressure water includes the step of maintaining a discharge of a low volume of water to enable the water to penetrate into the formation rather than migrating upwardly between the elongated member and the hole formed by the elongated member.

19. A hole forming device for forming a hole downwardly into the surface of the earth which comprises a frame, an elongated substantially vertically mounted planting member having a point at a lower end thereof for reciprocal movement on said frame to form or enlarge a hole in said surface by imparting a downward force on the planting member, and means discharging a high pressure, low volume liquid from the lower end of said planting member to enhance penetration of the planting member into a penetration resistant earth formation encountered when the planting member is moved downwardly to form or enlarge said hole in the earth.

20. The hole forming device as defined in claim 19 wherein said high pressure liquid is discharged from the lower end of said planting member at a pressure from 1,000 to 10,000 psi at a volume of less than 20 gpm.

21. The hole forming device in claim 19 wherein said means discharging high pressure liquid includes an axially extending discharge nozzle in a point at the lower end of the planting member.

22. The hole forming device in claim 21 and further including means applying vibrating forces to said planting member to enhance the penetrating capabilities of said point, said means moving said planting member vertically forming a primary penetrating force of substantially constant magnitude and the means applying vibrating forces and the means discharging high pressure liquid from the lower end of the planting member forming selectively applied additional penetrating forces to the planting member.

23. The hole forming device in claim 19 wherein said means discharging high pressure liquid includes a hollow manifold at the lower end of the planting member, said manifold including a plurality of downwardly opening orifices to discharge high pressure liquid peripherally of said lower end.

24. The hole forming device in claim 23 and further including means applying vibrating forces to said planting member to enhance the penetrating capabilities of said point, said means moving said planting member vertically forming a primary penetrating force of substantially constant magnitude and the means applying vibrating forces and the means discharging high pressure liquid from the lower end of the planting member forming selectively applied additional penetrating forces to the planting member.

25. The hole forming device in claim 19 wherein said means discharging low volume high pressure water includes orifice means discharging water at a high velocity axially downwardly and rotatably from the point on the planting member.

26. In a hole forming device having a frame and an elongated rigid planting member reciprocally mounted on said frame for forming or enlarging a hole in the surface of the earth by exerting a substantially constant downward force on the planting member into said surface, the improvement which comprises adapting said planting member with a conduit means for delivering a high pressure liquid to a lower end of said planting member during formation of said hole and discharge means connected to said conduit means for discharging a low volume of said high pressure liquid from the lower end of said planting member into an earth formation in advance of said lower end to separate and liquidify elements of the formation to facilitate penetration of the lower end of the planting member into the penetration resistant earth formation.

27. The hole forming device in claim 26 wherein said means discharging high pressure liquid includes an axially extending discharge nozzle in a point at the lower end of the planting member.

28. The hole forming device in claim 26 wherein said means discharging high pressure liquid includes a hollow manifold at the lower end of the planting member, said manifold including a plurality of downwardly opening orifices to discharge high pressure liquid peripherally of said lower end.

29. The hole forming device in claim 26 and further including means applying vibrating forces to said planting member to enhance the penetrating capabilities of said point, said means moving said planting member vertically forming a primary penetrating force of substantially constant magnitude and the means applying vibrating forces and the means discharging high pressure liquid from the lower end of the planting member forming selectively applied additional penetrating forces to the planting member.

30. The hole forming device in claim 26 wherein said means discharging low volume high pressure water includes orifice means discharging water at a high velocity axially downwardly and rotatably from the point on the planting member.

* * * * *